US006880497B1

(12) United States Patent
Avery, Jr. et al.

(10) Patent No.: US 6,880,497 B1
(45) Date of Patent: Apr. 19, 2005

(54) SYSTEM AND METHOD FOR CONTROLLING FAN ACTIVATION BASED ON INTAKE MANIFOLD AIR TEMPERATURE AND TIME IN AN EGR SYSTEM

(75) Inventors: Richard Michael Avery, Jr., West Bloomfield, MI (US); Leopold Super, Dearborn, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 10/670,589

(22) Filed: Sep. 25, 2003

(51) Int. Cl.[7] ..... F01P 7/02
(52) U.S. Cl. ..... 123/41.12
(58) Field of Search ..... 123/41.12

(56) References Cited

U.S. PATENT DOCUMENTS 4,469,079 A 9/1984 Cook
5,440,891 A 8/1995 Hindmon, Jr. et al.
5,732,676 A 3/1998 Weisman et al.
6,045,482 A 4/2000 Nishar et al.
6,188,189 B1 2/2001 Blake
6,230,668 B1 5/2001 Marsh et al.
6,345,594 B1 2/2002 Orschek et al.
6,453,853 B1 9/2002 Hawkins et al.
6,571,751 B1 6/2003 Vogt

OTHER PUBLICATIONS

Fan Controllers, Axiomatic Technologies Corp., http://www.axiomatic.com/fan–control.html.

*Primary Examiner*—Noah P. Kamen
(74) *Attorney, Agent, or Firm*—Brooks Kushman P.C.

(57) ABSTRACT

A method for controlling at least one engine cooling fan for a compression ignition internal combustion engine, the method includes turning on the at least one cooling fan when an intake manifold air temperature is equal to or greater than a predetermined turn-on threshold temperature for a predetermined turn-on time, and turning off the at least one cooling fan when the intake manifold air temperature is equal to or less than a predetermined turn-off threshold temperature for a predetermined turn-off time, wherein the predetermined turn-on threshold temperature is greater than the predetermined turn-off threshold temperature.

20 Claims, 5 Drawing Sheets

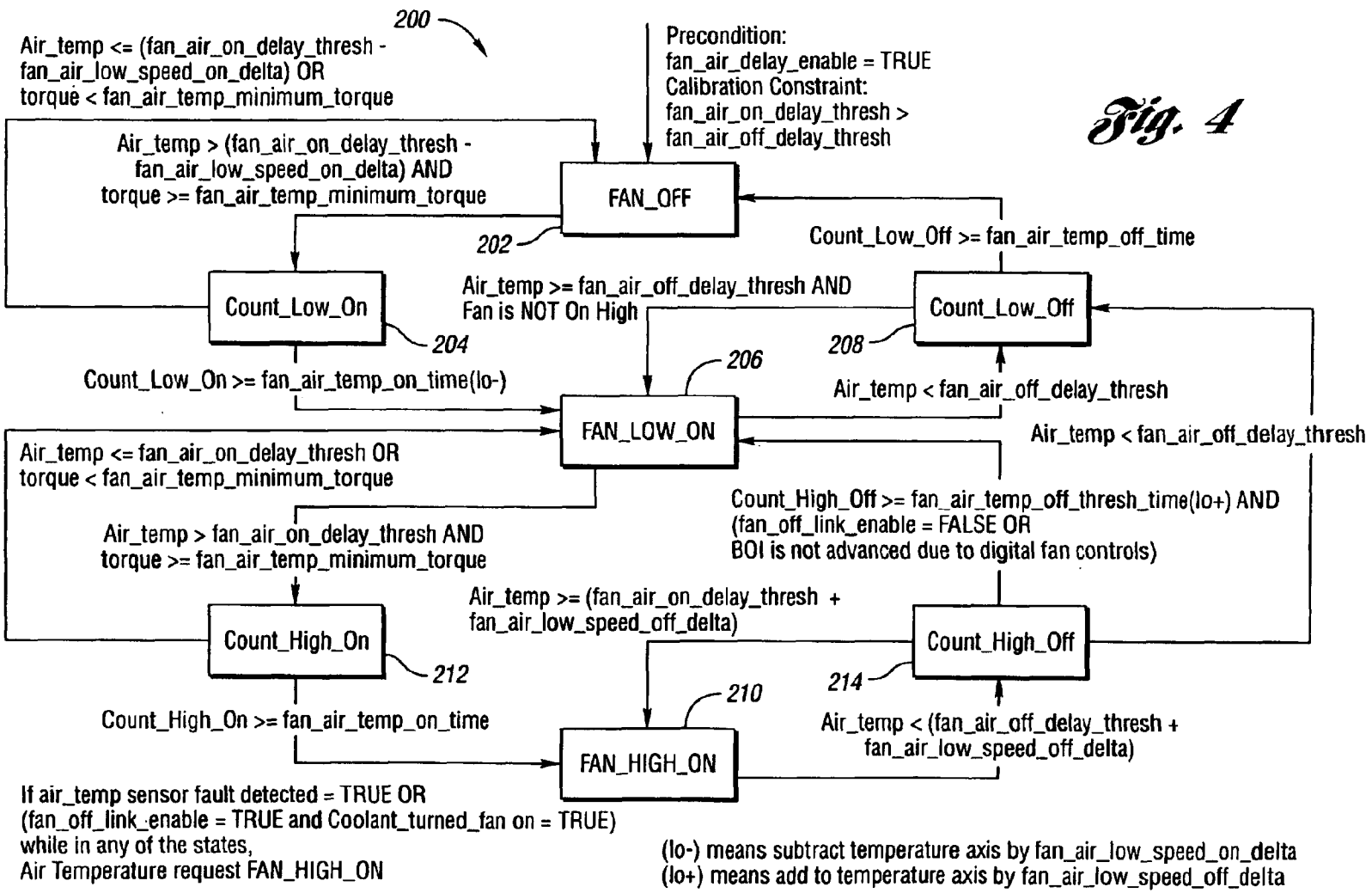
Fig. 4
200
Precondition:
fan_air_delay_enable = TRUE
Calibration Constraint:
fan_air_on_delay_thresh >
fan_air_off_delay_thresh
FAN_OFF
202
Air_temp <= (fan_air_on_delay_thresh -
fan_air_low_speed_on_delta) OR
torque < fan_air_temp_minimum_torque
Air_temp > (fan_air_on_delay_thresh -
fan_air_low_speed_on_delta) AND
torque >= fan_air_temp_minimum_torque
Count_Low_On
204
Count_Low_On >= fan_air_temp_on_time(lo-)
Count_Low_Off >= fan_air_temp_off_time
Count_Low_Off
208
Air_temp >= fan_air_off_delay_thresh AND
Fan is NOT On High
Air_temp < fan_air_off_delay_thresh
FAN_LOW_ON
206
Air_temp < fan_air_off_delay_thresh
Air_temp <= fan_air_on_delay_thresh OR
torque < fan_air_temp_minimum_torque
Air_temp > fan_air_on_delay_thresh AND
torque >= fan_air_temp_minimum_torque
Count_High_Off >= fan_air_temp_off_thresh_time(lo+) AND
(fan_off_link_enable = FALSE OR
BOI is not advanced due to digital fan controls)
Count_High_On
212
Count_High_On >= fan_air_temp_on_time
Air_temp >= (fan_air_on_delay_thresh +
fan_air_low_speed_off_delta)
Count_High_Off
214
Air_temp < (fan_air_off_delay_thresh +
fan_air_low_speed_off_delta)
FAN_HIGH_ON
210
If air_temp sensor fault detected = TRUE OR
(fan_off_link_enable = TRUE and Coolant_turned_fan on = TRUE)
while in any of the states,
Air Temperature request FAN_HIGH_ON
(lo-) means subtract temperature axis by fan_air_low_speed_on_delta
(lo+) means add to temperature axis by fan_air_low_speed_off_delta

SYSTEM AND METHOD FOR CONTROLLING FAN ACTIVATION BASED ON INTAKE MANIFOLD AIR TEMPERATURE AND TIME IN AN EGR SYSTEM

BACKGROUND OF THE INVENTION

1. Field of the Invention

The present invention relates to a system and a method for controlling engine cooling fan activation based on intake manifold air temperature and time in an exhaust gas recirculation (EGR) system.

2. Background Art

Internal combustion engines, and in particular, compression ignition (or diesel) engines have a wide variety of applications including passenger vehicles, marine vessels, earth-moving and construction equipment, stationary generators, and on-highway trucks, among others. However, due to the loads carried by the vehicles and the size of the machinery that utilize internal combustion engines, internal combustion engines (e.g., diesel engines) generate a great deal of heat during operation.

The heat generated by internal combustion engines has also increased due to the addition of exhaust gas recirculation (EGR) systems into the engines. EGR systems recirculate exhaust into the intake air stream of the engine, thereby reducing oxides of nitrogen that are formed when temperatures in the combustion chamber of the engine get too hot. Although the EGR systems help to reduce exhaust emissions that cause smog, EGR systems cause the intake manifold air temperatures of the engine to increase.

Some conventional systems and methods for controlling the heat within internal combustion engines implement a fixed speed, a variable speed, or multiple engine cooling fans that move air over a radiator where engine coolant flows and is cooled by the air movement. A conventional electronic control unit operates the fan in accordance with received fan request signals, turning the fan on or off and adjusting the fan speed depending on the temperature within the engine (e.g., in response to engine coolant temperature). However, some of the fan requests are unnecessary due to short increases in temperature caused by quick changes in engine load (e.g., small rolling hills, idle to rapid acceleration operation, intermittent workpiece characteristics for power takeoff driven applications, etc.). The unnecessary fan requests can cause the engine speed and output torque to fluctuate erratically. The engine speed and torque fluctuations can cause undesirable vehicle (or machinery) speed variations, noise and vibration, reduced fuel economy, etc.

Thus, there exists a need and an opportunity for an improved system and an improved method for engine cooling fan control. The present invention may implement an improved system and an improved method for controlling cooling fan activation and fan speed based on intake manifold air temperature and time in an EGR system. The present invention may minimize the unnecessary fan request signals as sent by some conventional approaches and, thus, may provide improved efficiency and noise control for operation of the fan activation system. Furthermore, the present invention may provide more flexible fan control parameters (i.e., a greater number of modes of engine cooling fan control) when compared to conventional approaches.

SUMMARY OF THE INVENTION

The present invention generally provides new, improved and innovative techniques for controlling engine cooling fan activation based on intake manifold temperature and time in an exhaust gas recirculation system. The improved system and method for engine fan control of the present invention may minimize unnecessary fan request signals as sent by some conventional approaches and may provide improved efficiency and noise control for operation of the fan activation system. Furthermore, the present invention may provide more flexible fan control parameters (i.e., a greater number of modes of engine cooling fan control) when compared to conventional approaches.

According to the present invention, a method for controlling at least one engine cooling fan for a compression ignition internal combustion engine is provided. The method comprises turning on the at least one cooling fan when an intake manifold air temperature is equal to or greater than a predetermined turn-on threshold temperature for a predetermined turn-on time, and turning off the at least one cooling fan when the intake manifold air temperature is equal to or less than a predetermined turn-off threshold temperature for a predetermined turn-off time, wherein the predetermined turn-on threshold temperature is greater than the predetermined turn-off threshold temperature.

Also according to the present invention, a system for controlling at least one cooling fan for a compression ignition internal combustion engine is provided. The system comprises at least one sensor for providing an indication of at least one engine component parameter and an engine controller in communication with the at least one engine component parameter sensor. The engine controller may be configured to turn on the at least one cooling fan when an intake manifold air temperature is equal to or greater than a predetermined turn-on threshold temperature for a predetermined turn-on time, and turn off the at least one cooling fan when the intake manifold air temperature is equal to or less than a predetermined turn-off threshold temperature for a predetermined turn-off time, wherein the predetermined turn-on threshold temperature is greater than the predetermined turn-off threshold temperature.

The above features, and other features and advantages of the present invention are readily apparent from the following detailed descriptions thereof when taken in connection with the accompanying drawings.

BRIEF DESCRIPTION OF THE DRAWINGS

FIG. 4 is a state diagram of another engine cooling fan mode of operation according to the present invention.

DETAILED DESCRIPTION OF THE PREFERRED EMBODIMENT(S)

With reference to the Figures, the preferred embodiments of the present invention will now be described in detail. Generally, the present invention provides an improved system and an improved method for engine cooling fan control.

The present invention is generally implemented in connection with an internal combustion engine (e.g., a compression ignition or diesel engine) having an exhaust gas recirculation (EGR) system. Since EGR systems recirculate exhaust gas into the intake air stream of the engine, EGR systems generally cause the intake manifold temperatures of the engine to increase. Intake air temperature generally increases when the EGR is actuated. As such, EGR activation time (i.e., "time in EGR") and intake manifold air temperature are generally directly related (or directly corresponding).

To control or optimize at least one mode of the engine (e.g., an internal combustion engine in general and a compression ignition engine in particular) operation and engine cooling fan operation where the respective operations are generally controlled by an electronic control module (ECM)/powertrain control module (PCM) or controller, the engine controller should be adaptable (i.e., programmable, modifiable, configurable, etc.) to a variety of input signals or parameters. However, conventional electronic engine controllers have a limited set of parameters that are used (i.e., monitored) by the controller to adjust (i.e., control) the engine operation and engine cooling fan operation.

Conventional approaches to control of engine cooling fan operation are generally limited to monitoring parameters such as engine coolant temperature (i.e., engine operating temperature), engine rotational speed, transmission retarder operational state, climate control operation, engine oil temperature, hydraulic oil sump temperature, transmission sump oil temperature, and intake manifold air (or inlet air) temperature, and to turning the engine cooling fan on or off, or varying the fan speed. In contrast, the system and method of the present invention in at least one mode of operation, generally activate a fan "on" request signal when the intake manifold air temperature has been at or above a first predetermined level for at least a first predetermined time (or, alternatively, the EGR has been activated for a first predetermined time). Similarly, the fan "on" signal may be presented until the intake manifold air temperature has been below a second predetermined level for a second predetermined time (or, alternatively, the EGR has been de-activated for a second predetermined time).

Figure 1:
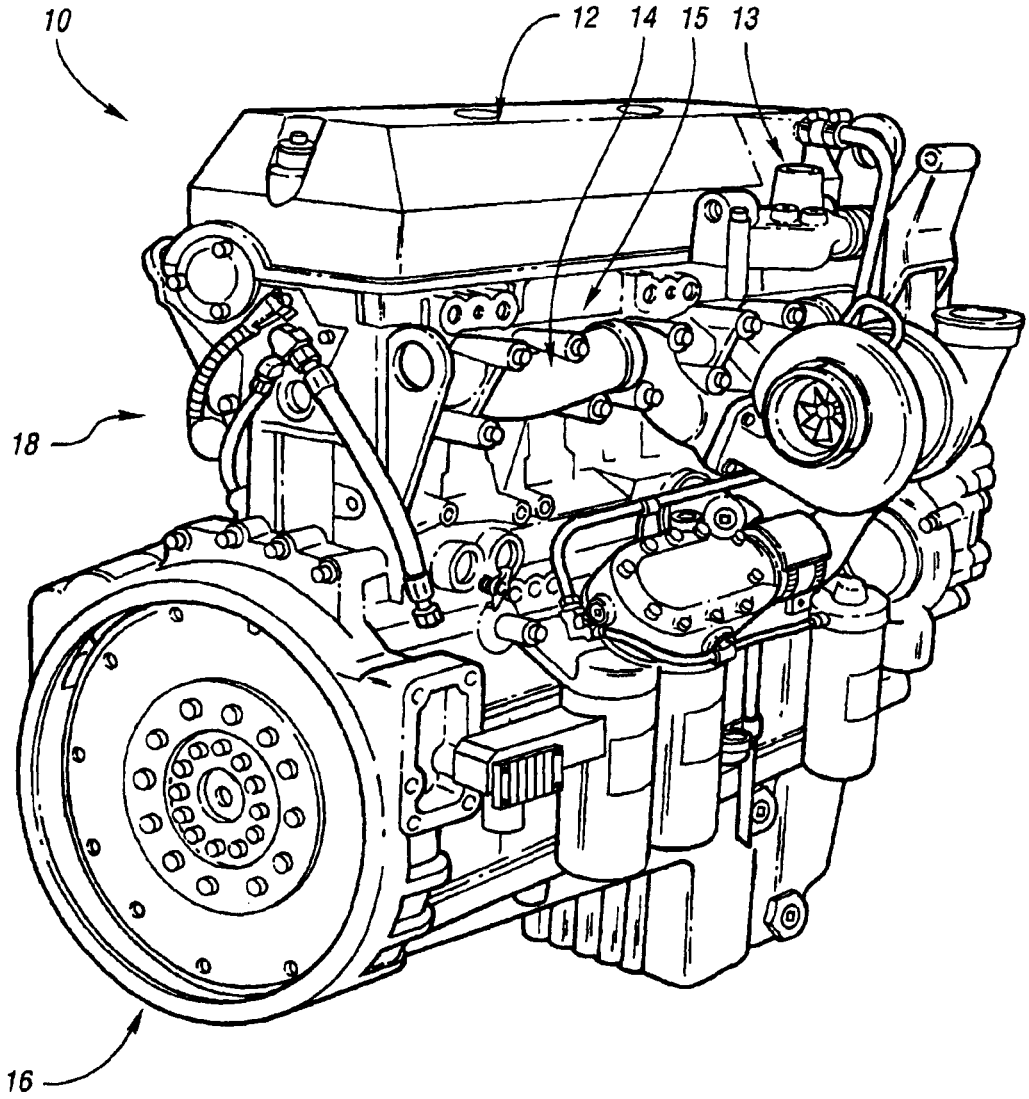
FIG. 1 is a diagram illustrating a compression ignition engine incorporating various features of the present invention.

Referring to FIG. 1, a perspective view illustrating a compression-ignition internal combustion engine 10 incorporating various features according to the present invention is shown. The engine 10 may be implemented in a wide variety of applications including on-highway trucks, construction equipment, marine vessels, stationary generators, pumping stations, and the like. The engine 10 generally includes a plurality of cylinders disposed below a corresponding cover, indicated generally by reference numeral 12.

In a preferred embodiment, the engine 10 is a multi-cylinder compression ignition internal combustion engine, such as a 3, 4, 6, 8, 12, 16, or 24 cylinder diesel engine. However, the engine 10 may be implemented having any appropriate number of cylinders 12, the cylinders having any appropriate displacement and compression ratio to meet the design criteria of a particular application. Moreover, the present invention is not limited to a particular type of engine or fuel. The present invention may be implemented in connection with any appropriate engine (e.g., Otto cycle, Rankine cycle, Miller cycle, etc.) using an appropriate fuel to meet the design criteria of a particular application. An EGR valve 13 is generally connected between an exhaust manifold 14 and an intake manifold 15. The EGR valve 13 generally provides recirculation of a portion of exhaust gas in response to at least one predetermined engine 10 operating condition (i.e., a time in EGR).

The engine 10 generally includes an engine control module (ECM), powertrain control module (PCM), or other appropriate controller 32 (described in detail in connection with FIG. 2*a*). The ECM 32 generally communicates with various engine sensors and actuators via associated interconnection cabling or wires 18, to control the engine 10 and at least one engine cooling fan. In addition, the ECM 32 generally communicates with an engine operator or user (not shown) using associated lights, switches, displays, and the like (not shown).

In one example, the engine 10 may be mounted (i.e., installed, implemented, positioned, disposed, etc.) in a vehicle (not shown). In another example, the engine 10 may be installed in a stationary environment. The engine 10 may be coupled to a transmission (not shown) via flywheel 16. Many transmissions include a power take-off (PTO) configuration where an auxiliary shaft (not shown) may be connected to associated auxiliary equipment (not shown). Cooling for the engine 10 is generally provided by at least one cooling fan 20 (described in connection with FIGS. 2*b* and 2*c*). The at least one cooling fan 20 may be positioned and configured to provide air movement over a radiator (not shown) where engine coolant is circulated and cooled by the air movement.

The auxiliary equipment may be driven by the engine 10/transmission at a relatively constant rotational speed using an engine variable speed governor (VSG) feature. The auxiliary equipment may include hydraulic pumps for construction equipment, water pumps for fire engines, power generators, and any of a number of other rotationally driven accessories. Typically, when the PTO apparatus is installed on a vehicle, the PTO mode is generally used while the vehicle is stationary. However, the present invention is independent of the particular operation mode of the engine 10, or whether the vehicle is stationary or moving for the applications in which the engine 10 is used in a vehicle having a PTO mode.

Figure 2A:
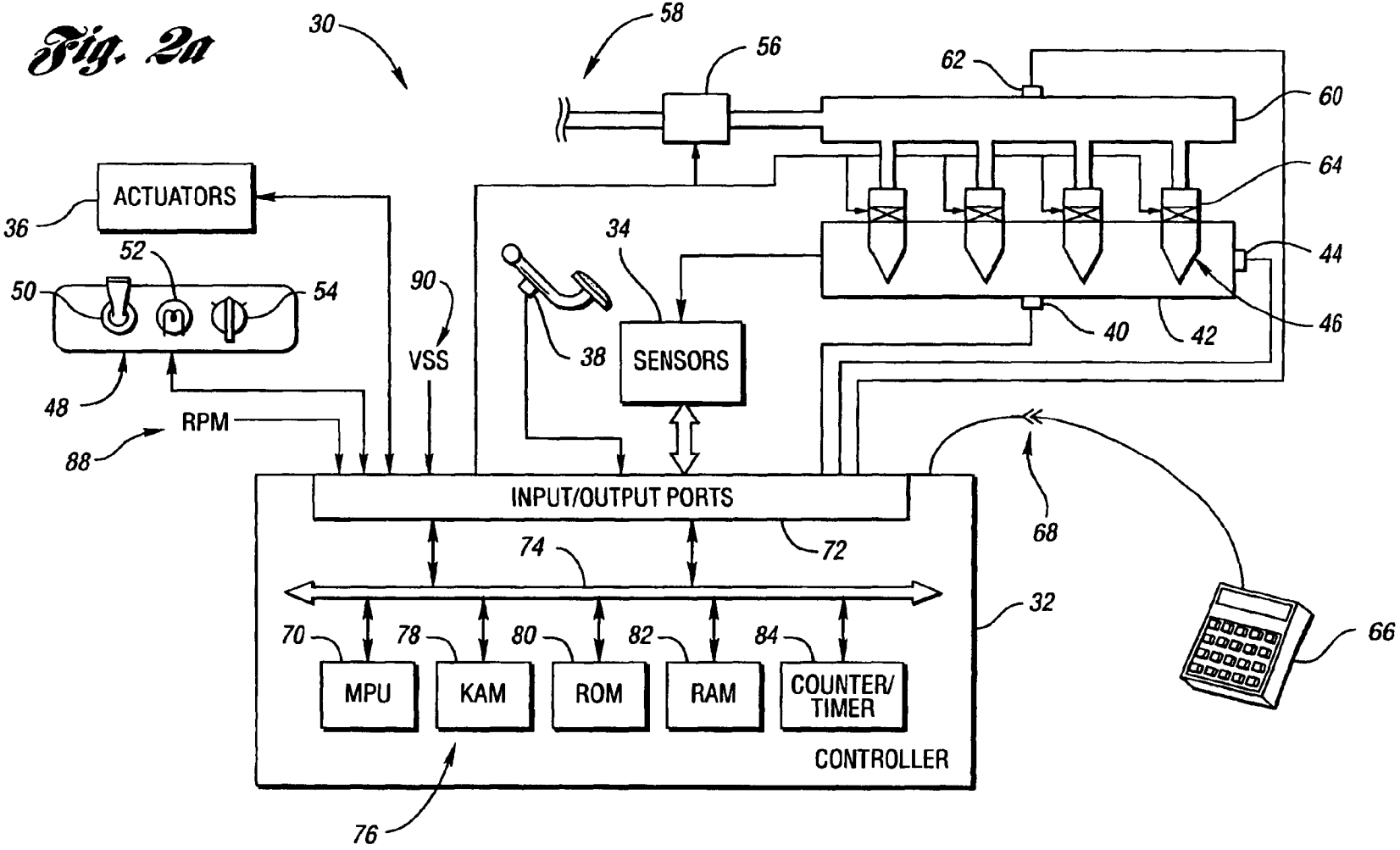
FIGS. 2(*a–c*) are diagrams illustrating a system for engine cooling fan control according to the present invention.

Referring to FIGS. 2(*a–c*), diagrams illustrating a system 30 for controlling an engine and for controlling at least one engine cooling fan, or for controlling an engine cooling fan according to the present invention are shown. The system 30 may be implemented in connection with the engine 10 of FIG. 1. As illustrated in FIG. 2*a*, the system 30 preferably includes the controller (e.g., ECM, PCM, and the like) 32 in communication with various sensors 34 and actuators 36. The sensors 34 may include various position sensors such as an accelerator or brake position sensor 38. Likewise, the sensors 34 may include a coolant temperature sensor 40 that generally provides an indication of the temperature of an engine block 42 and an intake manifold air temperature sensor that generally provides an indication of the temperature of the engine intake air at the inlet or within the intake manifold. Likewise, an oil pressure sensor 44 may be used to monitor the engine 10 operating conditions by providing an appropriate signal to the controller 32. Other sensors (not shown) may include at least one sensor that indicates actuation of an EGR control valve (not shown), at least one sensor that indicates actuation of the at least one cooling fans 20, and at least one sensor that indicates rotational speed of the at least one cooling fans 20.

Other sensors may include rotational sensors to detect the rotational speed of the engine 10, such as RPM sensor 88 and a vehicle speed sensor (VSS) 90 in some applications. The VSS 90 generally provides an indication of the rotational speed of the output shaft or tailshaft (not shown) of the transmission. The speed of the shaft monitored via the VSS 90 may be used to calculate the vehicle speed. The VSS 90 may also represent one or more wheel speed sensors which may be used in anti-lock breaking system (ABS) applications, vehicle stability control systems, and the like.

The actuators 36 may include various engine components which are operated via associated control signals from the controller 32. The various actuators 36 may also provide signal feedback to the controller 32 relative to the actuator 36 operational state, in addition to feedback position or other signals used to the control actuators 36. The actuators 36 preferably include a plurality of fuel injectors 46 which are controlled via associated (or respective) solenoids 64 to deliver fuel to the corresponding cylinders 12. The actuators 36 may include at least one actuator that may be implemented to control the at least one cooling fan 20.

In one embodiment, the controller 32 controls a fuel pump 56 to transfer fuel from a source 58 to a common rail or manifold 60. However, in another example, the present invention may be implemented in connection with a direct injection engine. Operation of the solenoids 64 generally controls delivery of the timing and duration of fuel injection (i.e., an amount, timing and duration of fuel). While the representative control system 30 illustrates an example application environment of the present invention, as noted previously the present invention is not limited to any particular type of fuel or fueling system and thus may be implemented in any appropriate engine and/or engine system to meet the design criteria of a particular application.

The sensors 34 and the actuators 36 may be used to communicate status and control information to the engine operator via a console 48. The console 48 may include various switches 50 and 54 in addition to indicators 52. The console 48 is preferably positioned in close proximity to the engine operator, such as in a cab (i.e., passenger compartment, cabin, etc.) of the vehicle (or environment) where the system 30 is implemented. The indicators 52 may include any of a number of audio and visual indicators such as lights, displays, buzzers, alarms, and the like. Preferably, one or more switches, such as the switch 50 and the switch 54, may be used to request at least one particular operating mode, such as climate control (e.g., air conditioning), cruise control or PTO mode, for example.

As used throughout the description of the present invention, at least one selectable (i.e., programmable, predetermined, modifiable, etc.) limit (i.e., threshold, level, interval, value, amount, duration, etc.) or range of values may be selected by any of a number of individuals (i.e., users, operators, owners, drivers, etc.) via a programming device, such as device 66 selectively connected via an appropriate plug or connector 68 to the controller 32. Rather than being primarily controlled by software, the selectable or programmable limit (or range) may also be provided by an appropriate hardware circuit having various switches, dials, and the like. Alternatively, the selectable or programmable limit may also be changed using a combination of software and hardware without departing from the spirit of the present invention. However, the at least one selectable value or range may be predetermined and/or modified by any appropriate apparatus and method to meet the design criteria of a particular application. Any appropriate number and type of sensors, indicators, actuators, etc. may be implemented to meet the design criteria of a particular application.

In one embodiment, the controller 32 generally includes a programmable microprocessing unit 70 in communication with the various sensors 34 and the actuators 36 via at least one input/output port 72. The input/output ports 72 may provide an interface in terms of processing circuitry to condition the signals, protect the controller 32, and provide appropriate signal levels depending on the particular input or output device. The processor 70 generally communicates with the input/output ports 72 using a data/address bus arrangement 74. Likewise, the processor 70 generally communicates with various types of computer-readable storage media 76 which may include a keep-alive memory (KAM) 78, a read-only memory (ROM) 80, a random-access memory (RAM) 82, and at least one timer (or a counter configured as a timer) 84.

The various types of computer-readable storage media 76 generally provide short-term and long-term storage of data (e.g., at least one lookup table, LUT, at least one operation control routine, etc.) used by the controller 32 to control the engine 10 and the cooling fan 20. The computer-readable storage media 76 may be implemented by any of a number of known physical devices capable of storing data representing instructions executable by the microprocessor 70. Such devices may include PROM, EPROM, EEPROM, flash memory, and the like in addition to various magnetic, optical, and combination media capable of temporary and/or permanent data storage.

The computer-readable storage media 76 may include data representing program instructions (e.g., software), calibrations, routines, steps, methods, blocks, operations, operating variables, and the like used in connection with associated hardware to control the various systems and subsystems of the engine 10, the cooling fan 20, and the vehicle. The engine/vehicle/cooling fan control logic is generally implemented via the controller 32 based on the data stored in the computer-readable storage media 76 in addition to various other electric and electronic circuits (i.e., hardware, firmware, etc.).

In one example, the controller 32 includes control logic to control at least one mode of operation of the engine 10 and at least one mode of operation of the fan 20. In another example, the controller 32 may be implemented as a fan controller and engine control may be performed via another controller (not shown). Modes of engine 10 operation that may be controlled include engine idle, PTO operation, engine shutdown, maximum permitted vehicle speed, maximum permitted engine speed (i.e., maximum engine RPM), whether the engine 10 may be started (i.e., engine start enable/disable), engine operation parameters that affect engine emissions (e.g., timing, amount and duration of fuel injection, exhaust air pump operation, etc.), cruise control enable/disable, seasonal shutdowns, calibration modifications, and the like.

The modes of operation of the at least one fan 20 are described below in connection with FIGS. 2(*a–c*), 3 and 4. In general, the fan 20 may be configured to turn on for at least one of excessive air temperature (i.e., intake or inlet air temperature at or above a predetermined value) and excessive engine coolant temperature (i.e., engine coolant temperature at or above a predetermined value). As used throughout the present application, the phrases air temperature or air inlet temperature may indicate at least one of intake manifold 15 air temperature, intake manifold 15 inlet air temperature, and time in EGR for the EGR 13.

The at least one timer 84 is generally configured to determine (i.e., calculate, count, etc.) at least one predetermined time interval (e.g., an interval having at least one corresponding control signal (e.g., FAN_AIR_TEMP$_{13}$ OFF_TIME (or FATOFT), and FAN$_{13}$ AIR_TEMP_ON_TIME (or FATONT)). The predetermined time intervals that correspond to the signals FATOFT and FATONT are generally determined via values in the LUT 76. The controller 32 may present (e.g., send, transmit, etc.) at least one fan 20 actuator control signal (e.g., FAN_ON, FAN_LOW_ON, and FAN_HIGH_ON) in response to at least one sensor 36 signal and at least one predetermined time (e.g., COUNT_LOW and COUNT_HIGH) determined by the timer 84 in response to at least one timer control signal (e.g., COUNT_ON, COUNT_OFF, COUNT_LOW_ON, COUNT_HIGH_ON, COUNT_LOW_OFF, and COUNT_HIGH_OFF).

In one example, the interval FATOFT may be a time to establish or determine a fan "off" point (or level) based on air temperature (e.g., intake manifold air temperature, inlet air temperature, etc., or alternatively, a time duration when the EGR 13 is not activated). In another example, for dual speed fan (or two-fan) 20 configurations the interval FATOFT may be a time to provide (i.e., establish, determine, etc.) a high speed (or normal speed) to low fan speed transition (e.g., a temperature axis positively offset by a value FAN_AIR_LOW_SPEED$_{13}$ OFF_DELTA). A transition may be implemented as a gradual turn on or turn off of the fan 20 over the respective time corresponding to the signals FATONT and PATOFT.

In one example, the interval FATONT may be a time provide (i.e., establish, determine, etc.) a fan "on" air temperature (e.g., intake manifold air temperature, inlet air temperature, etc., or alternatively, a time duration when the EGR 13 is activated) point (i.e., value, level, etc.) based on air temperature. In another example, for dual speed fan (or two-speed fan) 20 configurations the interval FATONT may be a time to establish or determine an off to low fan speed transition (e.g., a temperature axis negatively offset by a value FAN_AIR_LOW_SPEED_ON_DELTA).

The signal FAN_ON may be implemented as a control signal that may be presented to the actuator 36 to enable the fan 20 to turn "on." In a two-speed fan implementation, the signal FAN_LOW_ON may be implemented as a control signal that may be presented to the actuator 36 to enable the fan 20 to turn "on" at a low speed and the signal FAN_HIGH_ON may be implemented as a control signal that may be presented to the actuator 36 to enable the fan 20 to turn "on" at a high (or normal) speed (i.e., a speed that is higher than the low speed by at least a predetermined amount). In dual fan implementation, the signal FAN_LOW_ON may be implemented as a control signal that may be presented to the actuator 36 to enable a low speed fan 20 to turn "on" at a respective low speed and the signal FAN_HIGH_ON may be implemented as a control signal that may be presented to the actuator 36 to enable a high (or normal) speed fan 20 to turn "on" at a respective high speed (i.e., a speed that is higher than the low speed by at least a predetermined amount). An number of signals (e.g., FAN_OFF, FAN_LOW_OFF, and FAN_HIGH_OFF) generally correspond to turning off the fan 20, the low speed fan 20, and the high speed fan 20, respectively.

As described in detail in connection with FIGS. 2(*a–c*), 3 and 4, the system 30 may have a number of states (e.g., FAN_ON, FAN_OFF, FAN_LOW_ON, FAN_LOW_OFF, FAN_HIGH_ON, FAN_HIGH_OFF, COUNT_LOW, COUNT_HIGH, COUNT_ON, COUNT_OFF, COUNT_LOW_ON, COUNT_HIGH_ON, COUNT_LOW_OFF, and COUNT_HIGH_OFF). The states of the system 30 (i.e., states that correspond to control signals that are presented by the controller 32) may be operational states of the at least one fan 20 and the at least one timer (or counter) 84.

A variable (or parameter) (e.g., AIR_TEMP_FAN_OFF (or ATOFF)) may be a predetermined air temperature (e.g., an inlet air temperature, an intake manifold air temperature, etc.) that corresponds to a request (or signal) to turn off at least one fan 20. A variable (or parameter) (e.g., AIR_TEMP_FAN1_ON (or AFT1ON)) may be a predetermined air temperature that corresponds to request (or signal) to turn on at least one normal speed or high speed fan 20. A variable (or parameter) (e.g., AIR_TEMP_FAN2_ON (or AFT2ON)) may be a predetermined air temperature that corresponds to a request (or signal) to turn on at least one low speed fan 20. The signals AFT1ON and AFT2ON are generally implemented in connection with two-speed fan or dual fan applications of the present invention. The temperature that corresponds to the high speed (or normal speed) fan on signal AFT1ON is generally a higher temperature than the temperature that corresponds to the low speed fan on signal AFT2ON.

A control signal (e.g., FAN_AIR_DELAY_ENABLE (or FADENB)) may enable (i.e., turn on) logic in the controller 32 to provide fan 20 on/off time air temperature dependency (in contrast to methods using "hard" or fixed temperature thresholds) when set (i.e., "on", enabled, asserted, presented, transmitted, at a logic TRUE, HIGH or "1" state or level, etc.). In one example, the signal FADENB may correspond to a time that is equal to the amount of time the engine 10 is cranking for starting plus 5 seconds. However, the signal FADENB may correspond to any appropriate time to meet the design criteria of a particular application. A control signal (e.g., FAN_AIR_LOW_SPEED_OFF_DELTA (or FALOFD)) may correspond to a positive offset (or hysteresis) to the FATOFT temperature axis for a high speed fan 20 to low speed fan 20 operation transition.

A control signal (e.g., FAN_AIR LOW_SPEED_ON_DELTA (or FALOND)) may correspond to a negative offset (or hysteresis) to the FATONT temperature axis for an "off" to a low speed fan 20 operation transition. A control signal (e.g., FAN_AIR_OFF_DELAY_THRESH (or FADOFT)) may correspond to a temperature threshold (or hysteresis) that may be used by controller 32 logic to provide a time delay when requesting (or signaling) at least one fan 20 "off" mode. A control signal (e.g., FAN_AIR_ON_DELAY_THRESH (or FADONT)) may correspond to a temperature threshold (or hysteresis) that may be used by controller 32 logic to provide a time delay when requesting (or signaling) at least one fan 20 "on" mode. A signal (e.g., LO−) may provide for the subtraction of a temperature axis by the amount indicated by the signal FALOND. A signal (e.g., LO+) may provide for the addition of a temperature axis by the amount indicated by the signal FALOFD. The temperature that corresponds to the signal FAN_AIR_ON_DELAY_THRESH (or FADONT) is generally a higher temperature than the temperature that corresponds to the signal FAN_AIR_OFF_DELAY_THRESH (or FADOFT).

A control signal (e.g., FAN_AIR_TEMP_MINIMUM_TORQUE (or FATNTQ)) may correspond to a predetermine minimum final torque value that may be generated by the engine 10 before a predetermined high air inlet (or intake manifold) temperature (or, alternatively, a predetermined time when the EGR 13 is actuated) will turn on a fan 20. A control signal (e.g., COOL_TEMP_FAN_OFF) may correspond to a predetermined engine 10 coolant temperature below which, the fan 20 is generally turned off. A control signal (e.g., COOLANT_TURNED_FAN_ON) may correspond to a mode of operation where the at least one fan 20 was turned on in response to the engine coolant having a temperature at or above a predetermined value. A control signal (e.g., FAN_OFF_LINK_ENABLE or (FOLEN)) may, when set, provide for fan 20 deactivation, and provide for a beginning of ignition (BOI) advance signal to be disabled when both of the intake manifold (or inlet) air and engine coolant temperatures are equal to or less than the respective predetermined "off" levels. When the signal FOLEN is not set, the air intake manifold (or inlet) and engine coolant temperature conditions are generally independent of one another.

Figure 2B:
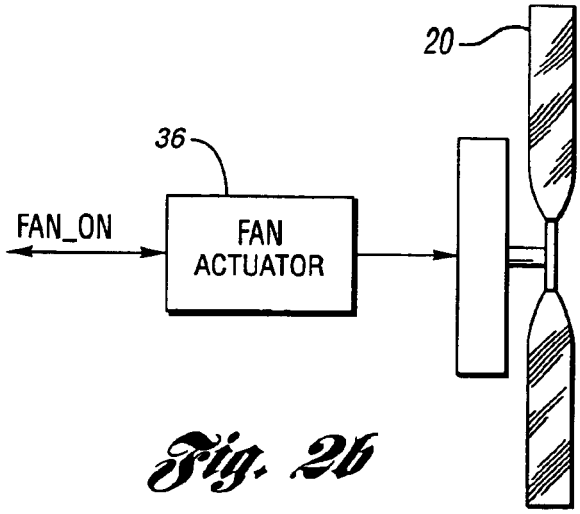

Referring to FIG. 2*b*, a diagram illustrating a single-fan implementation of the system 30 is shown. The fan actuator 36 generally turns on the fan 20 in response to the at least one signal FAN_ON. The fan 20 may be implemented as a single-speed fan, a multiple-speed (e.g., two-speed or dual speed, three-speed, etc.) fan, or a variable speed fan as indicated by a variable (e.g, FAN_TYPE or FANTYP). The signal FAN_ON is generally configured to control the fan 20 in a single-speed mode of operation, a multiple-speed mode of operation, or a variable speed mode of operation to meet the design criteria of a particular application. The fan 20 is generally implemented as a mechanically driven fan, an electrically driven fan, or a hydraulically driven fan. Accordingly, the actuator 36 is generally implemented as a mechanical actuator (e.g., a clutch such as an electromagnetic clutch), and electrical actuator (e.g., a fan relay), or a electro-hydraulic actuator, respectively. However, the fan 20 may be implemented with any appropriate drive mechanism to meet the design criteria of a particular application.

The variable FAN_TYPE (or FANTYP) generally provides an indication of the digital output fan type. In one example, the parameter FANTYP may be implemented using the following values, "0", may correspond to no function, "1" may correspond to single fan 20 implementation, "2" may correspond to a two (dual) fan 20 implementation, and "3" may correspond to a dual speed (two-speed) fan 20 implementation. However, the type of the at least one fan 20 that is implemented may be indicated via any appropriate signal and signal value to meet the design criteria of a particular application.

When the fan 20 is implemented as a multi-speed or variable speed fan, the fan rotational speed may be controlled by varying (i.e., adjusting, controlling, selecting, choosing, determining, etc.) at least one of pulse width modulation (PWM), voltage level (or amount), and current level (or amount) of the signal FAN_ON. However, the type of fan 20 and the speed of the fan 20 may be controlled via any appropriate adjustment parameter to meet the design criteria of a particular application.

Figure 2C:
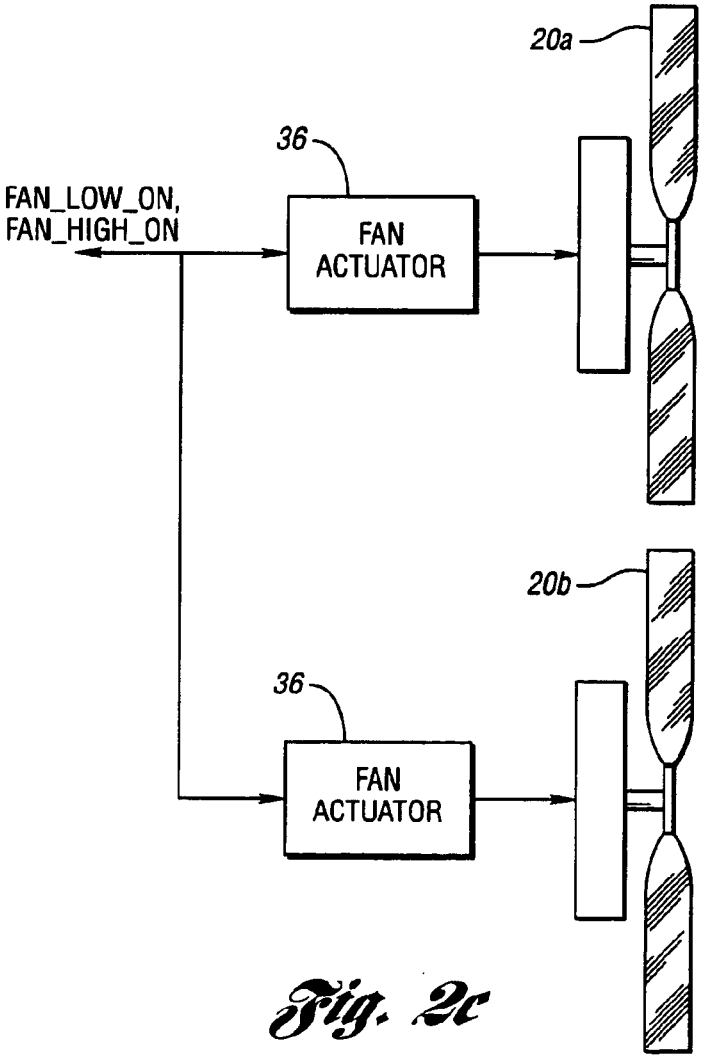

Referring to FIG. 2*c*, a diagram illustrating a multiple-fan (e.g., a two fan) implementation of the system 30 is shown. The system 30 illustrated in FIG. 2*c* may be implemented similarly to the system 30 illustrated in FIG. 2*b*. The fan 20*a* may be implemented as a single speed (e.g., a low speed) fan, a multiple-speed fan, or a variable speed fan that may be controlled via the control signal FAN_LOW_ON. The fan 20*b* may be implemented as a single speed (e.g., a high speed) fan, a multiple-speed fan, or a variable speed fan that may be controlled via the control signal FAN_HIGH_ON.

Figure 3:
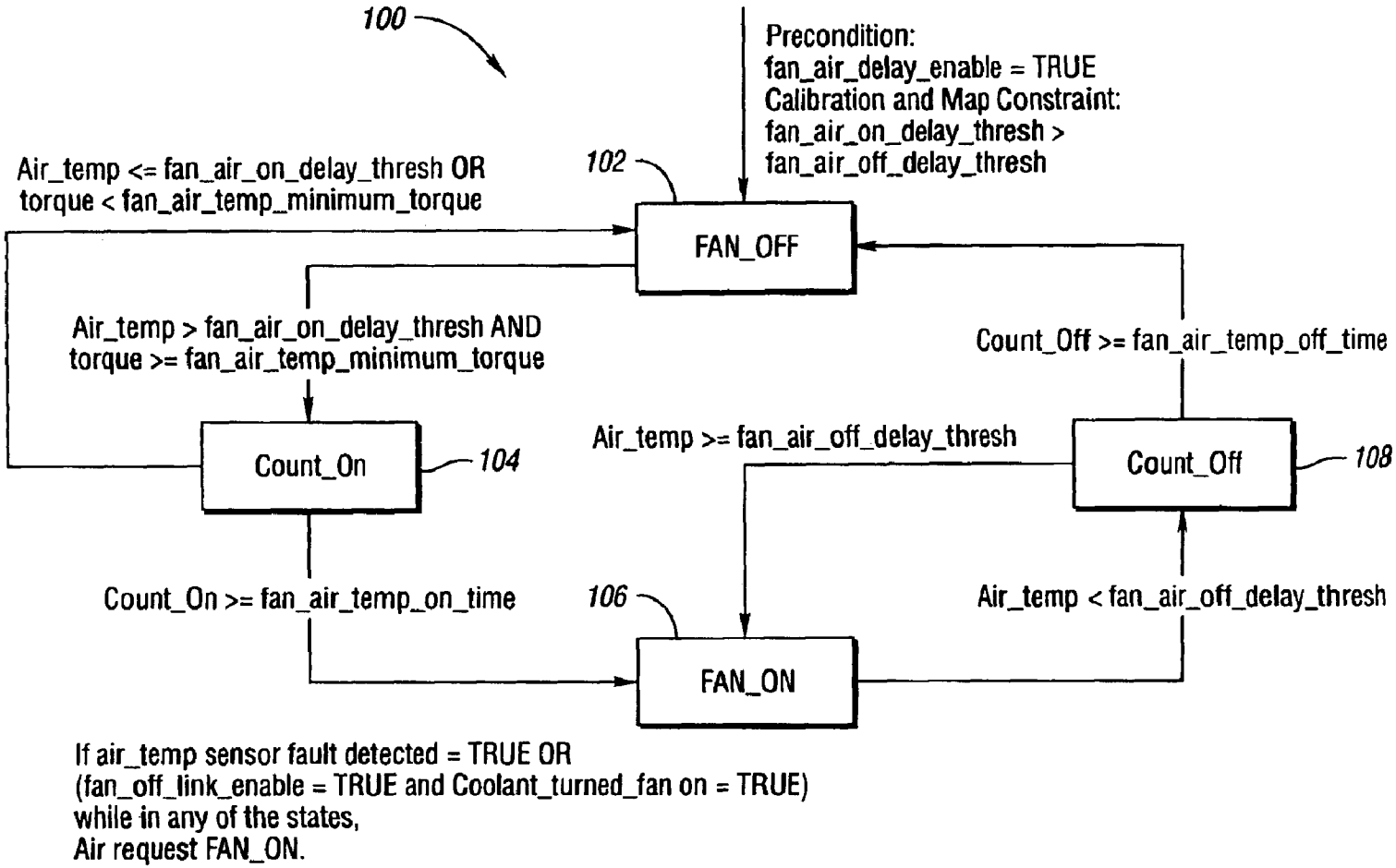
FIG. 3 is a state diagram of an engine cooling fan mode of operation according to the present invention.

Referring to FIG. 3, a state diagram illustrating an operation (i.e., process, routine, method, strategy, steps, blocks, etc.) 100 of the present invention is shown. The method 100 may be implemented in connection with the engine 10, the system 30, and the controller 32 (e.g., the process 100 may be implemented in connection with control logic in the controller 32). However, the method 100 may be implemented in connection with any appropriate engine, system, and controller to meet the design criteria of a particular application. The operation 100 is generally implemented as a single-fan engine cooling fan control routine.

The single speed fan 20 application generally implements a single fan control output signal (e.g., the signals FAN_ON, FAN_OFF) from the controller 32 to the actuator 36 to drive a single speed fan 20. The fan control output signal FAN_ON is generally not turned on (i.e., activated, presented, set, etc.) when the engine 20 is attempting to start or within 5 seconds after the engine 10 has started. The output signal FAN_ON is generally turned on (i.e., activated, asserted, presented, set, etc.) (block or state 106) when the signal FAN_AIR_DELAY_ENABLE is set, AND the air inlet temperature is equal to or greater than the value FAN_AIR_ON_DELAY_THRESH for at least the time FAN_AIR_TEMP_ON_TIME (as determined via the LUT 76 in response to air inlet temperature) (with a lower hysteresis of air inlet temperature equal to or less than the value FAN_AIR_OFF_DELAY_THRESH for at least the time interval FAN_AIR_TEMP_OFF_TIME AND when the variable FAN_OFF_LINK_ENABLE is set, the engine 10 coolant temperature is equal to or less than the value COOL_TEMP_FAN_OFF), AND the final torque generated by the engine 10 is equal to or greater than the value FAN_AIR_TEMP_MINIMUM_TORQUE.

The fan control with respect to the air inlet temperature (or intake manifold 15 temperature, or alternatively time in EGR 13) may be performed via one of at least two modes of operation. In one mode of operation, when the variable FAN_AIR_DELAY_ENABLE is not set, the "hard" (i.e., not adjusted by a threshold offset such as the values FAN_AIR_ON_DELAY_THRESH and FAN_AIR_OFF_DELAY_THRESH) threshold values AIR_TEMP_FAN1_ON and AIR_TEMP_FAN_OFF are generally referenced by the controller 32 to provide the appropriate signals to the actuator 36 turn the fan 20 on and off, respectively (e.g., FAN_ON and FAN_OFF).

In another mode of operation, when the variable FAN_AIR_DELAY_ENABLE is set, the variable FAN_AIR_ON_DELAY_THRESH and the variable FAN_AIR_TEMP_ON_TIME may provide a delay (or hysteresis) for turning on the fan 20 in response to the length of time that the intake manifold temperature (or air inlet temperature, or alternatively the time in EGR 13) remains above a predetermined level. Similarly, for turning the fan off (block or state 102), when the variable FAN_AIR_DELAY_ENABLE is set and air inlet temperature equal to or less than the value of FAN_AIR_OFF_DELAY_THRESH and at least the value FAN_AIR_TEMP_OFF_TIME (as determined from the LUT 76 as a function of air inlet temperature) may be used by the controller 32 to may provide a delay (or hysteresis) to the length of time to determine when to turn the fan 20 off.

The method 100 generally provides for the COUNT_ON timer 84 (block or state 104) to determine (or calculate) a value COUNT_ON that is equal to or greater than the variable FAN_AIR_TEMP_ON_TIME. The method 100 generally provides for the COUNT_OFF timer 84 (block or state 108) to determine (or calculate) a value COUNT_OFF that is equal to or greater than the variable FAN_AIR_TEMP_OFF_TIME.

When a variable (e.g., AIR_TEMP_SENSOR_FAULT_DETECTED) indicates that there is a fault in at least one of the sensors 34 that is related to the determination of intake manifold 15 air temperature, inlet air temperature, and EGR 13 actuation, the controller 32 may assert the signal FAN_ON, and the fan 20 may be operated.

Referring to FIG. 4, a state diagram illustrating a operation (i.e., process, routine, method, steps, blocks, etc.) 200 of the present invention is shown. The method 200 may be implemented similarly to the method 100. The method 200 is generally implemented in connection with a two-speed fan control application or a dual fan control application (e.g., the system 30 illustrated in FIG. 2*c*). The method 200 may provide at least one mode of operation for a 2-speed fan or dual fan application in response to air temperature (i.e., intake manifold 15 air temperature, inlet air temperature, or alternatively, time in EGR 13) when the control signal FAN_AIR_DELAY_ENABLE is set.

The two-speed (or dual) fan application of the system 30 generally implements two control signals (e.g., the signals FAN_LOW_ON and FAN_HIGH_ON) to drive (i.e., control) two single speed fans 20 (e.g., a low speed fan 20*a* and a high speed fan 20*b* or vice versa) or, alternatively, to drive a single fan 20 at a low speed or a high (or normal) speed, respectively. The two fans 20 (or the low and high fan speeds) generally operate independently of one another with fan 20*a* turning on for one set of conditions and fan 20*b* turning on for a different set of conditions. The conditions for turning on the fans 20*a* and 20*b* may be related. As in all modes of operation, neither fan output signal FAN_LOW_ON and FAN_HIGH_ON is turned on (block or state 202) while the engine 10 is attempting to start or within 5 seconds after having started (i.e., the signals FAN_LOW_ON and FAN_HIGH_ON are generally not asserted until the signal FAN_AIR_DELAY_ENABLE is TRUE).

The fan 20*a* may be turned on (or the low speed of the fan 20 may be turned on) (block or state 206) when the variable FAN_AIR_DELAY_ENABLE is set, AND the air inlet temperature is equal to or greater than the value FAN_AIR_ON_DELAY_THRESH for at least the time FAN_AIR_TEMP_ON_TIME (as determined in the LUT 76 in response to air inlet temperature (with a lower hysteresis of the air inlet temperature equal to or less than the value FAN_AIR_OFF_DELAY_THRESH for at least the time FAN_AIR_TEMP_OFF_TIME) AND the final torque generated by the engine 10 is equal to or greater than the value FAN_AIR_TEMP_MINIMUM_TORQUE The fan control with respect to the air inlet temperature can be performed via one of at least two modes of operation. In one mode of operation, when the parameter FAN_AIR_DELAY_ENABLE is not set, "hard" (i.e., not adjusted by a threshold offset such as the values FAN_AIR_ON_DELAY_THRESH and FAN_AIR_OFF_DELAY_THRESH) intake air temperature equal to or greater than (or less than) the AIR_TEMP_FAN1_ON and AIR_TEMP_FAN_OFF threshold values may be used to turn the fan 20*a* on (block 206) and off, respectively. When the parameter FAN_AIR_DELAY_ENABLE is set, the value FAN_AIR_ON_DELAY_THRESH and the time duration FAN_AIR_TEMP_ON_TIME provide a delay to turning the fan 20*a* on in response to the length of time that the air inlet temperature remains equal to or higher than a predetermined value. Similarly, for turning the fan 20*a* off, when the parameter FAN_AIR_DELAY_ENABLE is set, and the air inlet temperature is equal to or less than the predetermined value FAN_AIR_OFF_DELAY_THRESH, the FAN_AIR_TEMP_OFF_TIME (as determined form the LUT 76 in response to air inlet temperature) may be implemented to determine when to turn the fan 20*a* off (block or state 202).

A two speed fan 20 (or dual fan 20) application of the system 30 generally implements both of the output signals FAN_LOW_ON and FAN_HIGH_ON to drive a two speed fan 20 (or the fans 20*a* and 20*b*). When the fan control output signal FAN_LOW_ON is asserted, the fan 20 operates in low speed mode (or the fan 20*a* operates). When the fan control output signals FAN_LOW_ON and FAN_HIGH_ON are asserted, the fan 20 generally operates in a high speed mode (the fan 20*b* operates, or alternatively, or both fans 20*a* and 20*b* operate). When the two speed fan (or dual fan) operation 200 is implemented, the air, coolant, and oil temperature sensors may each have a low speed and high speed calibration (i.e., respective predetermined temperature values) to determine which fan speed will be asserted. The air temperature based engine cooling fan control may implement the strategy described above or the alternative method described below in response to the state of the variable FAN_AIR_DELAY_ENABLE.

The low speed fan 20*a* (or the low speed of the fan 20) may be turned on (i.e., the signal FAN_LOW_ON may be asserted) (block or state 206) when the high speed fan 20*b* (or the high speed mode of the fan 20) is not currently on or has not been turned on within the time that corresponds to the time FAN_AIR_DELAY_ENABLE, when the signal FAN_AIR_DELAY_ENABLE is set, AND the air inlet temperature is equal to or greater than the FAN_AIR_ON_DELAY_THRESH value minus the FAN_AIR_LOW_SPEED_ON_DELTA value for at least a time FAN_AIR_TEMP_ON_TIME (as determined from the LUT 76 in response to the air inlet temperature with a negative offset equal to the value FAN_AIR_LOW_SPEED_ON_DELTA) (with a lower hysteresis of the air inlet temperature less than the value FAN_AIR_OFF_DELAY_THRESH for FAN_AIR_TEMP_OFF_TIME) AND the final torque generated by the engine 10 is equal to or greater than the value FAN_AIR_TEMP_MINIMUM_TORQUE.

The high speed fan 20*b* (or alternatively, the high speed mode of the fan 20) is turned on (block or state 210) (i.e., the output signals FAN_LOW_ON and FAN_HIGH_ON are both asserted or turned on) when the parameter FAN_AIR_DELAY_ENABLE is set, AND the air inlet temperature is equal to or greater than the FAN_AIR_ON_DELAY_THRESH value for at least the time FAN_AIR_TEMP_ON_TIME (as determined via the LUT 76 in response to the air inlet temperature) (with a lower hysteresis of the air inlet temperature equal to or less than the value FAN_AIR_OFF_DELAY_THRESH for the time FAN_AIR_TEMP_OFF_TIME) AND when the value FAN_OFF_LINK_ENABLE is set, the engine coolant temperature is equal to or less than the value COOL_TEMP_FAN_OFF AND the final torque generated by the engine 10 is above (i.e., equal to or greater than) the value FAN_AIR_TEMP_MINIMUM_TORQUE. The predetermined high speed fan 20 (e.g., fan 20*b*) turn-on threshold temperature is generally greater than the predetermined low speed fan (e.g., fan 20*a*) turn-on threshold temperature.

When the high speed fan 20*b* (or the high speed mode of the fan 20, state 210) is turned on, the fan 20*b* (or the fan 20) may switch (or transition) to a low speed mode of operation (block or state 206) when none of the above conditions are met and when the variable FAN_AIR_DELAY_ENABLE is set, AND the air inlet temperature is equal to or less than the FAN_AIR_ON_DELAY_THRESH value plus the FAN_AIR_LOW_SPEED_OFF_DELTA value for at least the interval FAN_AIR_TEMP_OFF_TIME (as determined from the LUT 76 in response to the air inlet temperature with a positive offset equal to the value FAN_AIR_LOW_SPEED_OFF_DELTA) AND, the parameter FAN_OFF_LINK_ENABLE is not set OR the BOI is not advanced based on the digital fan controls (with a lower hysteresis of air inlet temperature equal to or less than the value FAN_AIR_OFF_DELAY_THRESH for at least the interval FAN_AIR_TEMP_OFF_TIME (for fan off transition)).

The method 200 generally provides for the COUNT_LOW_ON timer 84 (block or state 204) to determine (or calculate) a value COUNT_LOW_ON that is equal to or greater than the variable FAN_AIR_TEMP_ON_TIME minus the temperature axis determined by the value FAN_AIR_LOW_SPEED_ON_DELTA. The method 200 generally provides for the COUNT_LOW_OFF timer 84 (block or state 208) to determine (or calculate) when the value COUNT_LOW_OFF is equal to or greater than the variable FAN_AIR_TEMP_OFF_TIME. The method 200 generally provides for the COUNT_HIGH_ON timer 84 (block or state 212) to determine (or calculate) when the value COUNT_HIGH_ON is equal to or greater than the variable FAN_AIR_TEMP_ON_TIME. The method 200 generally enables the COUNT_HIGH_OFF timer 84 (block or state 214) to determine (or calculate) when the value COUNT_HIGH_OFF is equal to or greater than the variable FAN_AIR_TEMP_OFF_TIME.

When the variable AIR_TEMP_SENSOR_FAULT_DETECTED indicates that there is a fault in at least one of the sensors 34 that is related to the determination of intake manifold 15 air temperature, inlet air temperature, and EGR 13 actuation, the controller 32 may assert the signal FAN_HIGH_ON, and the high speed fan 20*b* may be turned on or the fan 20 may be operated in a high speed mode.

As is readily apparent from the foregoing description, then, the present invention generally provides an improved apparatus (e.g., the system 30) and an improved method (e.g., the method 100 and the method 200) for controlling an engine cooling fan. The improved system and method of the present invention may provide a greater number of input and output control parameters than conventional approaches. Furthermore, the present invention may provide more flexible engine control (i.e., a greater number of modes of control) when compared to conventional approaches.

While the control signals of the present invention have been described as set when the signal is "on", enabled, asserted, presented, transmitted, at a logic TRUE, HIGH or "1 "state or level, etc., the control signals may be set when "off", disabled, de-asserted, not presented, not transmitted, at a logic FALSE, LOW or "0" state or level, etc., or alternatively, any of the control signal states may be reversed or inverted to meet the design criteria of a particular application.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for controlling at least one engine cooling fan for a compression ignition internal combustion engine, the method comprising:

turning on the at least one cooling fan when an intake manifold air temperature is equal to or greater than a predetermined turn-on threshold temperature for a predetermined turn-on time; and turning off the at least one cooling fan when the intake manifold air temperature is equal to or less than a predetermined turn-off threshold temperature for a predetermined turn-off time, wherein the predetermined turn-on threshold temperature is greater than the predetermined turn-off threshold temperature.

2. The method of claim 1 further comprising determining the predetermined turn-on time and the predetermined turn-off time via a look up table and in response to the intake manifold air temperature.

3. The method of claim 1 further comprising turning off the at least one cooling fan when an engine coolant temperature is below a predetermined temperature.

4. The method of claim 3 further comprising turning off the at least one cooling fan when both of the intake manifold air temperature and the engine coolant temperature are equal to or less than respective predetermined temperatures when the intake manifold air and engine coolant temperatures are independent of one another.

5. The method of claim 1 further comprising turning on the at least one cooling fan when a final torque generated by the engine is equal to or greater than a predetermined value.

6. The method of claim 1 further comprising delaying turn-on of the at least one fan when the engine is attempting to start or within 5 seconds after starting.

7. The method of claim 1 further comprising determining the predetermined turn-on time and the predetermined turn-off time using a counter.

8. The method of claim 1 further comprising turning on the at least one fan when there is a fault in at least one sensor related to determination of the intake manifold air temperature.

9. The method of claim 1 further comprising:

turning on a low speed one of the at least one fans when the air inlet temperature is equal to or greater than a predetermined low turn-on threshold temperature for a predetermined low turn-on time;

turning off the low speed fan when the intake manifold air temperature is equal to or less than a predetermined low turn-off threshold temperature for a predetermined low turn-off time, wherein the predetermined low turn-on threshold temperature is greater than the predetermined low turn-off threshold temperature;

turning on a high speed one of the at least one fans when the air inlet temperature is equal to or greater than a predetermined high turn-on threshold temperature for a predetermined high turn-on time; and turning off the high speed fan when the intake manifold air temperature is equal to or less than a predetermined high turn-off threshold temperature for a predetermined high turn-off time, wherein the predetermined high turn-on threshold temperature is greater than the predetermined high turn-off threshold temperature and the predetermined high turn-on threshold temperature is greater than the predetermined low turn-on threshold temperature.

10. The method of claim 9 further comprising transitioning off the high speed fan when the intake manifold air temperature is equal to or less than the predetermined high turn-off threshold temperature plus a low offset value for the predetermined high turn-off time.

11. A system for controlling at least one cooling fan for a compression ignition internal combustion engine, the system comprising:

at least one sensor for providing an indication of at least one engine component parameter; and an engine controller in communication with the at least one engine component parameter sensor, the engine controller configured to;

turn on the at least one cooling fan when an intake manifold air temperature is equal to or greater than a predetermined turn-on threshold temperature for a predetermined turn-on time; and turn off the at least one cooling fan when the intake manifold air temperature is equal to or less than a predetermined turn-off threshold temperature for a predetermined turn-off time, wherein the predetermined turn-on threshold temperature is greater than the predetermined turn-off threshold temperature.

12. The system of claim 11 wherein the controller is further configured to determine the predetermined turn-on time and the predetermined turn-off time via a look up table and in response to the intake manifold air temperature.

13. The system of claim 11 wherein the controller is further configured to turn off the at least one cooling fan when an engine coolant temperature is below a predetermined temperature.

14. The system of claim 13 wherein the controller is further configured to turn off the at least one cooling fan when both of the intake manifold air temperature and the engine coolant temperature are equal to or less than respective predetermined temperatures when the intake manifold air and engine coolant temperatures are independent of one another.

15. The system of claim 14 wherein the controller is further configured to turning on the at least one cooling fan when a final torque generated by the engine is equal to or greater than a predetermined value.

16. The system of claim 11 wherein the controller is further configured to delay turning on the at least one fan when the engine is attempting to start or within 5 seconds after starting.

17. The system of claim 11 wherein the controller is further configured to determine the predetermined turn-on time and the predetermined turn-off time using a counter.

18. The system of claim 11 wherein the controller is further configured to turn on the at least one fan when there is a fault in at least one sensor related to determination of the intake manifold air temperature.

19. The system of claim 11 wherein the controller is further configured to:

turn on a low speed one of the at least one fans when the air inlet temperature is equal to or greater than a predetermined low turn-on threshold temperature for a predetermined low turn-on time;

turn off the low speed fan when the intake manifold air temperature is equal to or less than a predetermined low turn-off threshold temperature for a predetermined low turn-off time, wherein the predetermined low turn-on threshold temperature is greater than the predetermined low turn-off threshold temperature;

turn on a high speed one of the at least one fans when the air inlet temperature is equal to or greater than a predetermined high turn-on threshold temperature for a predetermined high turn-on time; and turn off the high speed fan when the intake manifold air temperature is equal to or less than a predetermined high turn-off threshold temperature for a predetermined high turn-off time, wherein the predetermined high turn-on threshold temperature is greater than the predetermined high turn-off threshold temperature and the predetermined high turn-on threshold temperature is greater than the predetermined low turn-on threshold temperature.

20. The system of claim 11 wherein the controller is further configured to transition off the high speed fan when the intake manifold air temperature is equal to or less than the predetermined high turn-off threshold temperature plus a low offset value for the predetermined high turn-off time.

* * * * *